US010561207B2

(12) United States Patent
Lin

(10) Patent No.: US 10,561,207 B2
(45) Date of Patent: Feb. 18, 2020

(54) ZIPPER SLIDER ASSEMBLY STRUCTURE AND CONNECTING RING THEREOF

(71) Applicant: WEIFANG ZHONG CHUAN ZIP FASTENER ACCESSORY CO., LTD., Weifang, Shandong (CN)

(72) Inventor: Yu-Pau Lin, Taoyuan (TW)

(73) Assignee: WEIFANG ZHONG CHUAN ZIP FASTENER ACCESSORY CO., LTD., Weifang, Shandong (CN)

( * ) Notice: Subject to any disclaimer, the term of this patent is extended or adjusted under 35 U.S.C. 154(b) by 0 days.

(21) Appl. No.: 16/222,291

(22) Filed: Dec. 17, 2018

(65) Prior Publication Data

US 2019/0343244 A1 Nov. 14, 2019

(30) Foreign Application Priority Data

May 9, 2018 (TW) ..... 107115749 A

(51) Int. Cl.
*A44B 19/26* (2006.01)

(52) U.S. Cl.
CPC ..... *A44B 19/262* (2013.01)

(58) Field of Classification Search
CPC ..... A44B 19/262; A44B 19/30; A44B 19/306; A44B 19/308
See application file for complete search history.

(56) References Cited

U.S. PATENT DOCUMENTS 2,502,055 A * 3/1950 Morin ..... A44B 19/30 24/421
2,524,574 A * 10/1950 Ryser ..... A44B 19/262 24/421
2,629,908 A * 2/1953 Keck ..... F16L 33/03 24/20 S
2,786,250 A * 3/1957 Garsson ..... A44B 19/262 24/416
3,225,405 A * 12/1965 Moser ..... A44B 19/30 24/423

(Continued)

FOREIGN PATENT DOCUMENTS

TW 201347694 A 12/2013
TW M544227 U 7/2017
TW M549544 U 10/2017

*Primary Examiner* — Robert Sandy
*Assistant Examiner* — Rowland Do
(74) *Attorney, Agent, or Firm* — Li & Cai Intellectual Property (USA) Office

(57) ABSTRACT

A zipper slider assembly structure and a connecting ring are provided. The zipper slider assembly structure includes a sliding assembly, a connecting ring, and a pull element. The sliding assembly includes a sliding element having a through hole, an elastic element disposed on the sliding element, and a movable fixing element movably disposed on the sliding element. The elastic element is elastically abutted against the movable fixing element. An end of the movable fixing element has a limiting part passing through the through hole. The connecting ring movably cooperates with the movable fixing element. The pull element movably cooperates with the connecting ring. The connecting ring has an outer arc surface contacting the sliding assembly and the pull element by point-contact to decrease a contact area between the connecting ring and the sliding assembly and between the connecting ring and the pull element.

4 Claims, 10 Drawing Sheets

(56) References Cited

U.S. PATENT DOCUMENTS 3,284,864 A * 11/1966 Howell ..... A44B 19/308 24/424
3,324,522 A * 6/1967 Howell ..... A44B 19/308 24/424
3,516,127 A * 6/1970 Howell ..... A44B 19/30 24/423
3,729,781 A * 5/1973 Fukuroi ..... A44B 19/308 24/424
3,924,306 A * 12/1975 Oda ..... A44B 19/308 24/424
4,512,064 A * 4/1985 Nishikawa ..... A44B 19/262 24/429
4,982,479 A * 1/1991 Oda ..... A44B 19/26 24/419
4,985,969 A * 1/1991 Terada ..... A44B 19/262 24/419
5,083,349 A * 1/1992 Axtell ..... A44B 19/262 24/415
5,086,546 A * 2/1992 Aoki ..... A44B 19/26 24/429
5,255,418 A * 10/1993 Chen ..... A44B 19/308 24/419
5,544,394 A * 8/1996 Yaguramaki ..... A44B 19/308 24/424
5,809,622 A * 9/1998 Yaguramaki ..... A44B 19/308 24/421
5,956,819 A * 9/1999 Terasaki ..... A44B 19/26 24/432
6,497,016 B1 * 12/2002 Lin ..... A44B 19/308 24/418
6,510,594 B2 * 1/2003 Lin ..... A44B 19/308 24/419
7,111,367 B2 * 9/2006 Keyaki ..... A44B 19/26 24/381
9,125,459 B1 * 9/2015 Lin ..... A44B 19/26
9,844,246 B2 * 12/2017 Yamagishi ..... A44B 19/308
2002/0189057 A1 * 12/2002 Lin ..... A44B 19/308 24/421
2004/0034974 A1 * 2/2004 Arai ..... A44B 19/262 24/429
2006/0075611 A1 * 4/2006 Yamagishi ..... A44B 19/306 24/418
2014/0123445 A1 * 5/2014 Jung ..... A44B 19/308 24/424
2016/0007694 A1 * 1/2016 Smith ..... A44B 19/26 24/418
2018/0035765 A1 * 2/2018 Lin ..... A44B 19/308
2018/0168292 A1 * 6/2018 Shah ..... A44B 19/306

* cited by examiner

ZIPPER SLIDER ASSEMBLY STRUCTURE AND CONNECTING RING THEREOF

CROSS-REFERENCE TO RELATED PATENT APPLICATION

This application claims the benefit of priority to Taiwan Patent Application No. 107115749, filed on May 9, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a zipper slider assembly structure and a connecting ring thereof, and more particularly to a zipper slider assembly structure and a connecting ring thereof for decreasing a contact area.

BACKGROUND OF THE DISCLOSURE

Buttons and zipper structures are commonly used in clothing. Compared to buttons, zipper structures have a wider range of usability and stronger structural properties. Generally, a zipper structure has a zipper slider and a zipper chain. The zipper slider can be guided by the zipper chain for being pulled back and forth on the zipper structure and can be widely applied in clothing and accessories. However, the conventional zipper slider still leaves room for improvement.

SUMMARY OF THE DISCLOSURE

In response to the above-referenced technical inadequacies, the present disclosure provides a zipper slider assembly structure and a connecting ring thereof to decrease a contact area between the connecting ring and a sliding assembly so as to effectively reduce a friction consumption thereof and decrease a contact area between the connecting ring and a pull element so as to effectively reduce a friction consumption thereof.

In one aspect, the present disclosure provides a zipper slider assembly structure includes a sliding assembly, a connecting ring, and a pull element. The sliding assembly includes a sliding element, an elastic element, and a movable fixing element. The sliding element has a through hole. The elastic element is disposed on the sliding element and is elastically abutted against the movable fixing element. The movable fixing element is movably disposed on the sliding element. An end of the movable fixing element has a limiting part passing through the through hole. The connecting ring movably cooperates with the movable fixing element. The pull element movably cooperates with the connecting ring. The connecting ring is formed by encircling a wire rod into a loop with a predetermined diameter. The connecting ring has a first end, a second end, and an interface-connecting structure connected between the first end and the second end. A material of the interface-connecting structure and a material of the connecting ring are the same or different. The connecting ring has an outer arc surface. The outer arc surface of the connecting ring contacts the sliding assembly and the pull element by point-contact.

In one aspect, the present disclosure provides a zipper slider assembly structure includes a sliding assembly, a connecting ring, and a pull element. The sliding assembly includes a movable fixing element. The connecting ring is formed by encircling a wire rod into a loop with a predetermined diameter. The connecting ring movably cooperates with the movable fixing element. The pull element movably cooperates with the connecting ring.

In certain embodiments, the present disclosure provides a connecting ring applied to a zipper slider assembly structure. The connecting ring movably cooperates with a pull element and a movable fixing element of the zipper slider assembly structure. The connecting ring is formed by encircling a wire rod into a loop with a predetermined diameter.

Further, the sliding assembly includes a sliding element and an elastic element. The sliding element has a base part and a bottom part. The elastic element has a fixed part fixed on the bottom part, an elastic part extending from the fixed part, and an abutted part extending from the elastic part and abutted against the movable fixing element. The movable fixing element movably contacts the abutted part of the elastic element. A thickness of the elastic part is smaller than a thickness of the fixed part.

Further, the sliding assembly includes a sliding element and an elastic element. The sliding element has a base part and a bottom part. The elastic element has a first fixed part fixed on the bottom part, a second fixed part fixed on the bottom part, an elastic part extending from the first fixed part, an abutted part extending from the elastic part and abutted against the abutted part of the movable fixing element, and an exposed part connected between the first fixed part and the second fixed part and exposed from an outside of the bottom part. The movable fixing element movably contacts the abutted part of the elastic element. The movable fixing element is movably disposed on the bottom part.

Therefore, the zipper slider assembly structure and the connecting ring thereof have technical features of "the connecting ring movably cooperates with a pull element and a movable fixing element of the zipper slider assembly structure" and "the connecting ring is formed by encircling a wire rod into a loop with a predetermined diameter" to decrease the contact area between the connecting ring and the sliding assembly so as to effectively reduce the friction consumption thereof and decrease the contact area between the connecting ring and the pull element so as to effectively reduce the friction consumption thereof.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
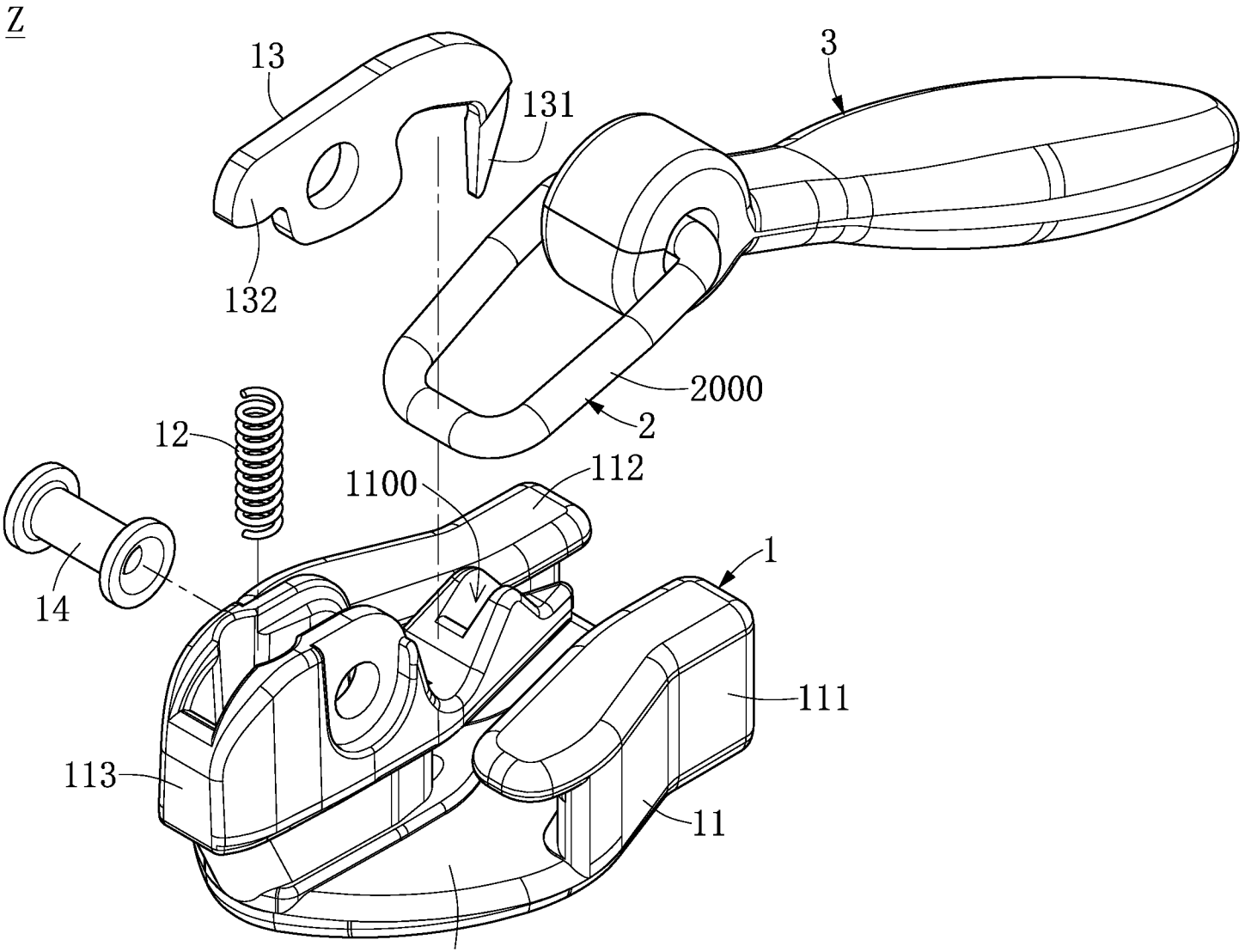
FIG. 1 is an exploded view of a zipper slider assembly structure according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 4, a first embodiment of the present disclosure provides a zipper slider assembly structure Z. The zipper slider assembly structure Z includes a sliding assembly 1, a connecting ring 2, and a pull element 3. The sliding assembly 1 includes a sliding element 11, an elastic element 12, and a movable fixing element 13. The sliding element 11 has a through hole 1100. The elastic element 12 is disposed on the sliding element 11 and elastically abutted against the movable fixing element 13. The movable fixing element 13 is movably disposed on the sliding element 11. An end of the movable fixing element 13 has a limiting part 131 passing through the through hole 1100. Another end of the movable fixing element 13 has a retaining part 132. In addition, the connecting ring 2 can movably cooperate with the movable fixing element 13 and the pull element 3 can movably cooperate with the connecting ring 2. In other words, the connecting ring 2 can be applied to the zipper slider assembly structure Z and the connecting ring 2 can movably cooperate with the pull element 3 and the movable fixing element 13 of the zipper slider assembly structure Z. For example, the elastic element 12 can be any type of spring or flat spring, and the movable fixing element 13 can be a horse-like hook or other types of hook. However, the present disclosure is not limited thereto.

Figure 2:
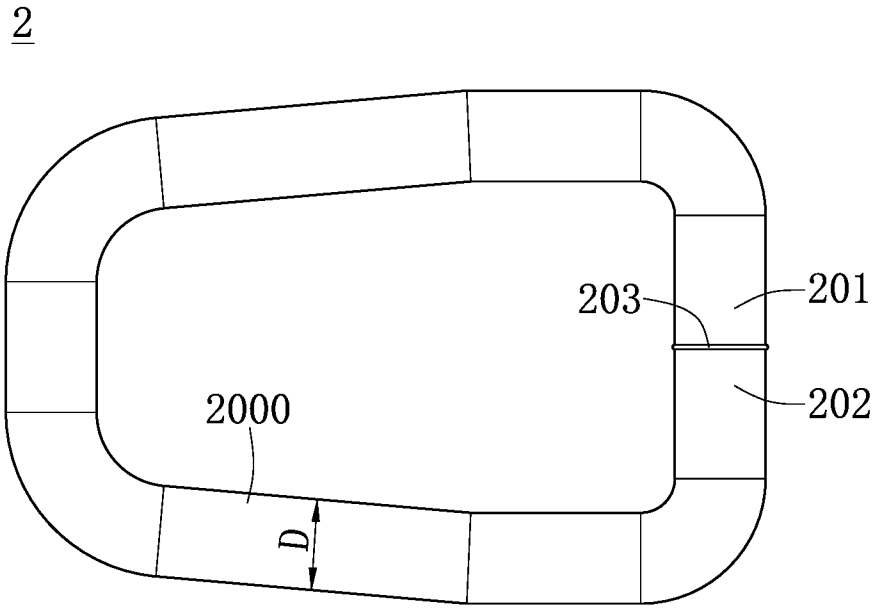
FIG. 2 is a schematic view of a connecting ring of the zipper slider assembly structure according to the first embodiment of the present disclosure.

Further, referring to FIG. 1 and FIG. 2, the connecting ring 2 is formed by encircling a wire rod into a loop with a predetermined diameter D. The connecting ring 2 has a first end 201, a second end 202, and an interface-connecting structure 203 connected between the first end 201 and the second end 202. It should be noted that a material of the interface-connecting structure 203 and a material of the connecting ring 2 can be the same or different. For example, when the first end 201 and the second end 202 of the wire rod with the predetermined diameter are directly connected (by soldering), the interface-connecting structure 203 is formed by a part of the first end 201 and a part of the second end 202; therefore, the material of the interface-connecting structure 203 and the material of the connecting ring 2 are the same. When the first end 201 and the second end 202 of the wire rod with the predetermined diameter are connected via a solder (by soldering), the interface-connecting structure 203 is formed by the solder; therefore, the material of the interface-connecting structure 203 and the material of the connecting ring 2 are different. However, the present disclosure is not limited thereto.

Figure 3:
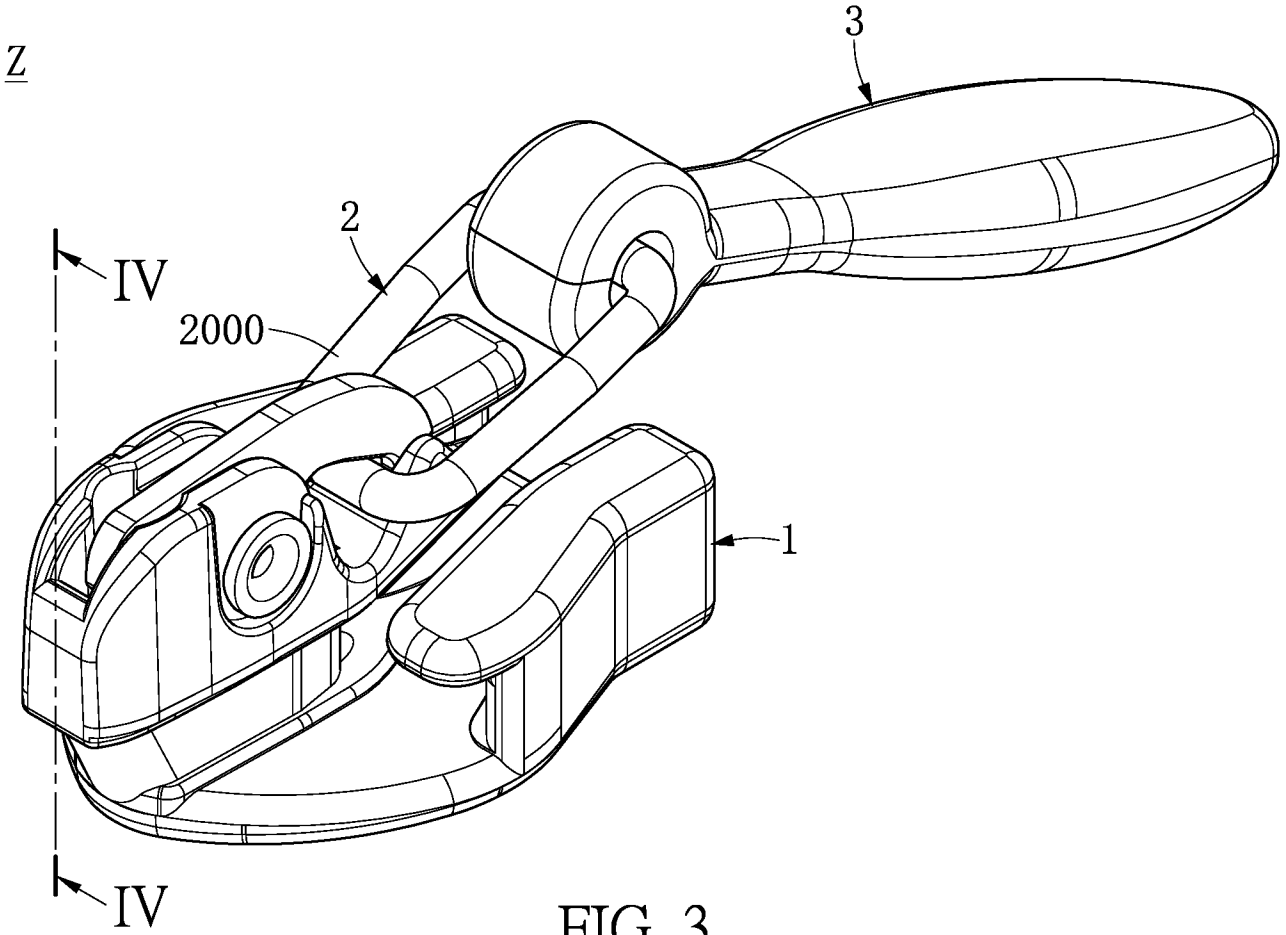
FIG. 3 is an assembled perspective view of the zipper slider assembly structure according to the first embodiment of the present disclosure.
Figure 4:
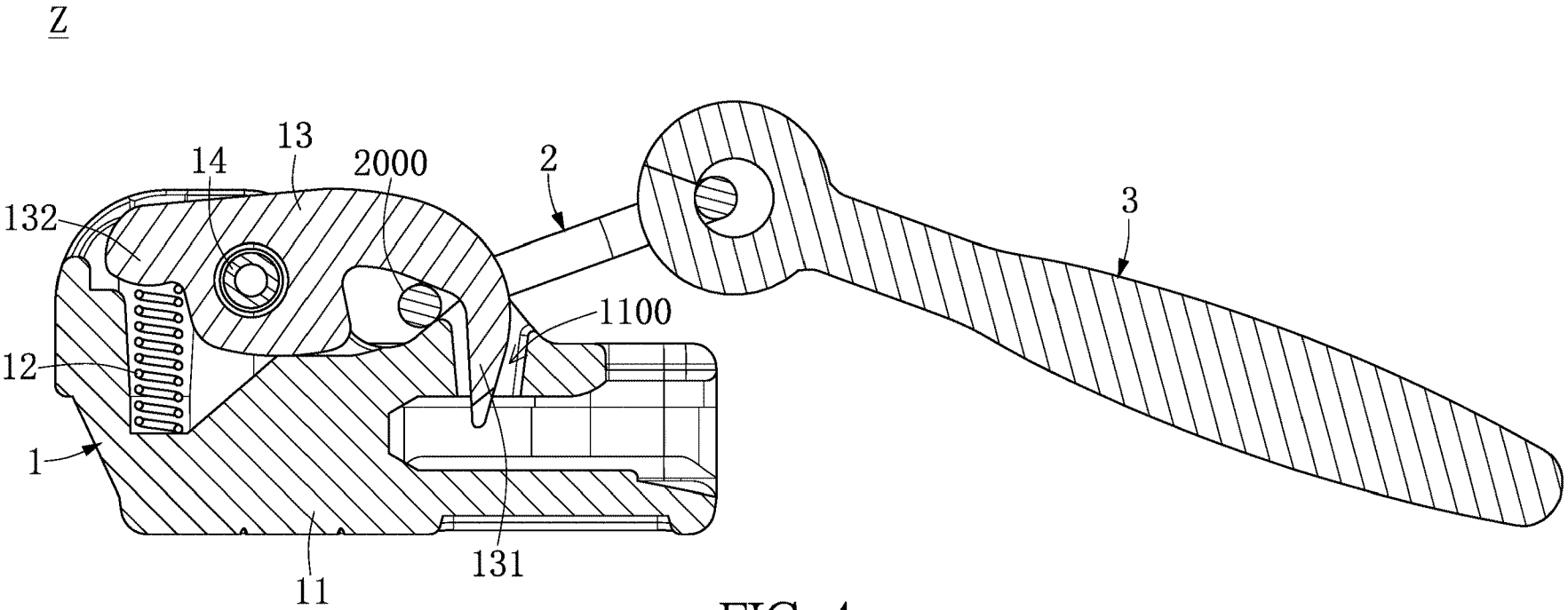
FIG. 4 is a cross-sectional view taken along line IV-IV of FIG. 3.

Furthermore, referring to FIG. 3 and FIG. 4, the connecting ring 2 has an outer arc surface 2000. The outer arc surface 2000 of the connecting ring 2 contacts both the sliding assembly 1 and the pull element 3 by point-contact. Therefore, with the use of the connecting ring 2 having the outer arc surface 2000, the present disclosure can not only decrease a contact area between the connecting ring 2 and the sliding assembly 1 to effectively reduce a friction consumption thereof but also decrease a contact area between the connecting ring 2 and the pull element 3 to effectively reduce a friction consumption thereof.

For instance, referring to FIG. 1 and FIG. 4, the sliding element 11 has a base part 110, a first side baffle 111, a second side baffle 112, and a bottom part 113. The first side baffle 111 and the second side baffle 112 respectively extend upward from two opposite edges of the base part 110. The first side baffle 111 and the second side baffle 112 cooperate with each other and are connected with a front edge of the base part 110. The bottom part 113 is disposed on the base part 110 and is connected with a back edge of the base part 110. The through hole 1100 extends through the bottom part 113 and is arranged between the first side baffle 111 and the second side baffle 112. The movable fixing element 13 is movably disposed on the bottom part 113; for example, the movable fixing element 13 can be pivotally disposed on the bottom part 113 via a pin 14. However, the present disclosure is not limited thereto.

Second Embodiment

Figure 5:
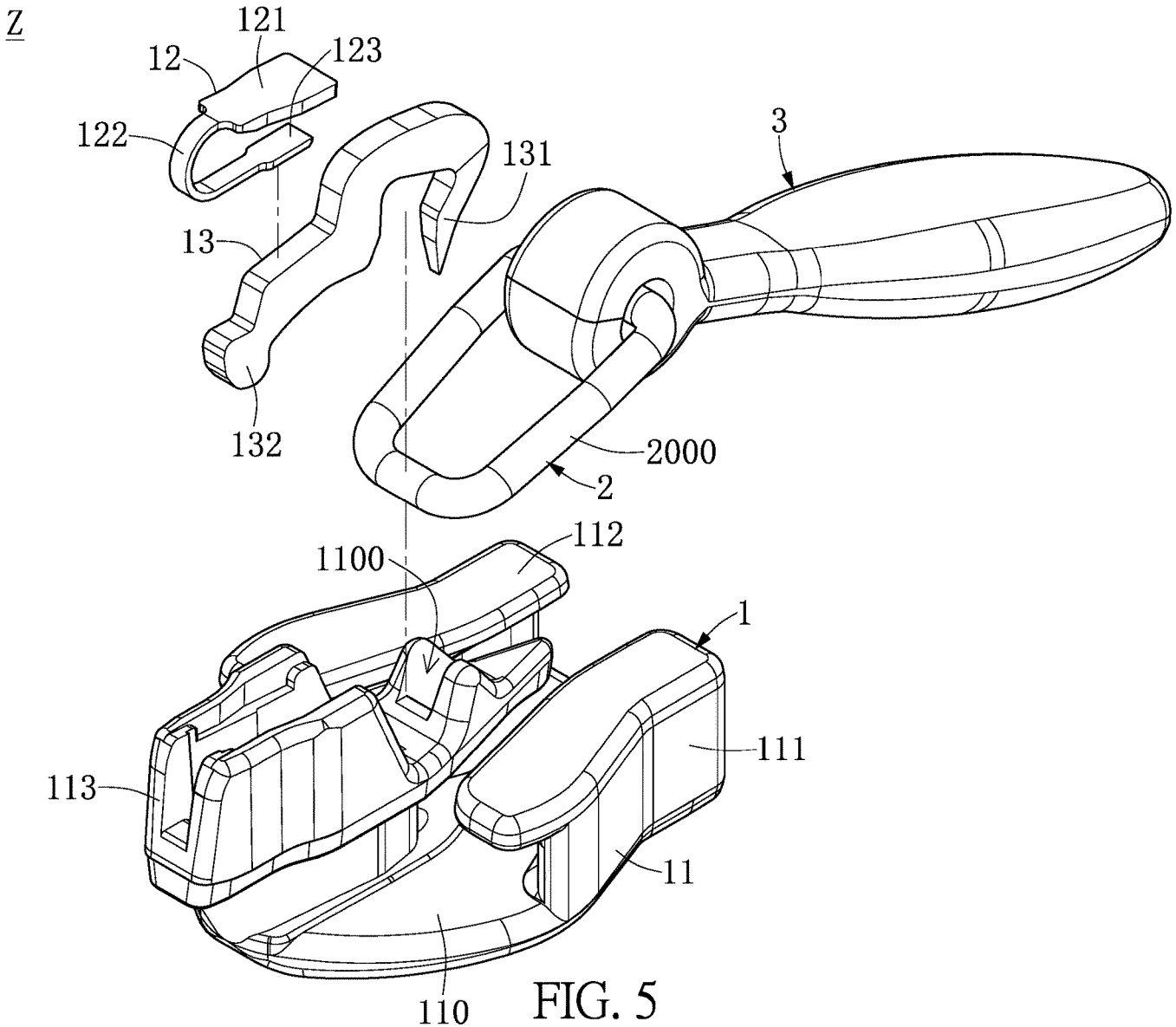
FIG. 5 is an exploded view of the zipper slider assembly structure according to a second embodiment of the present disclosure.
Figure 6:
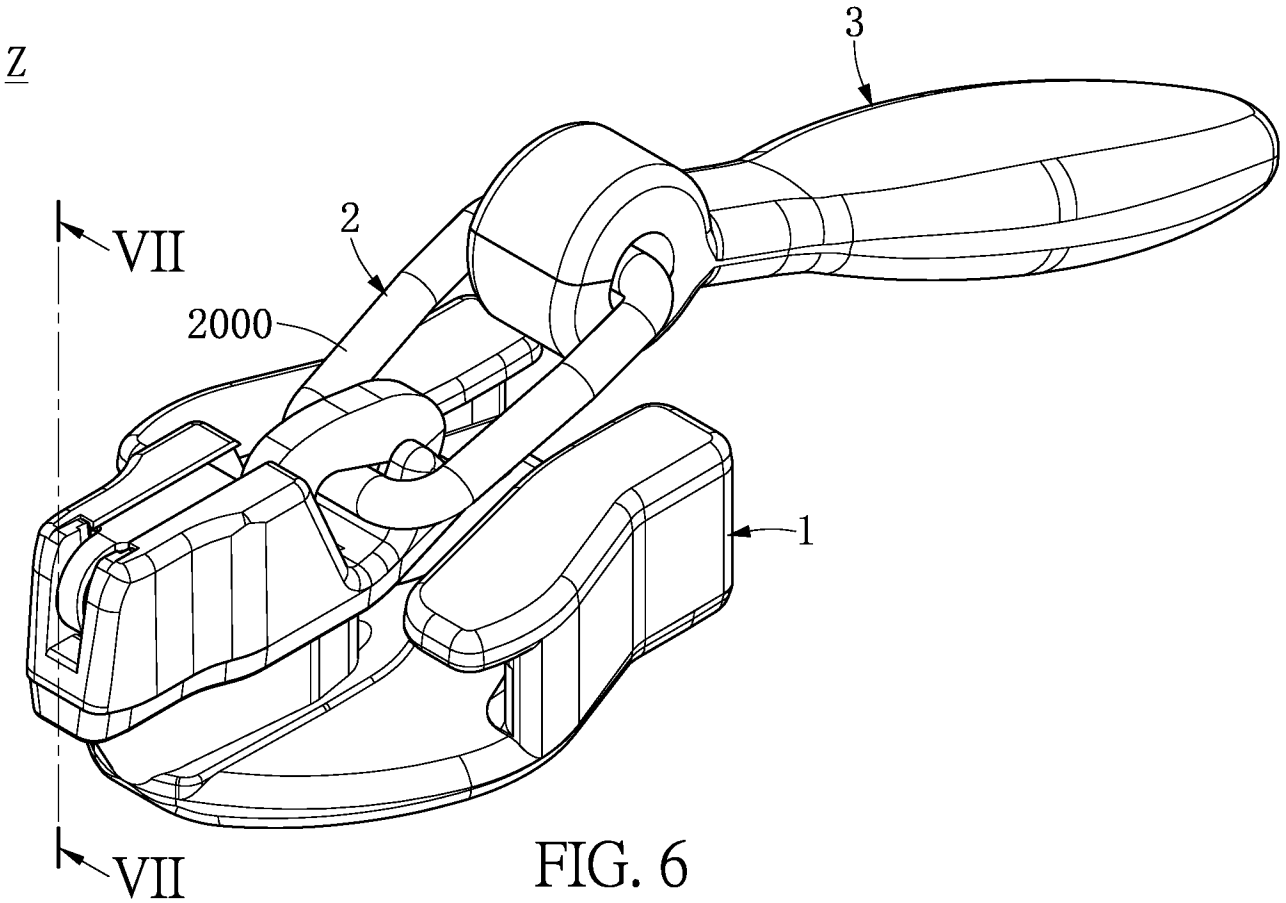
FIG. 6 is an assembled perspective view of the zipper slider assembly structure according to the second embodiment of the present disclosure.
Figure 7:
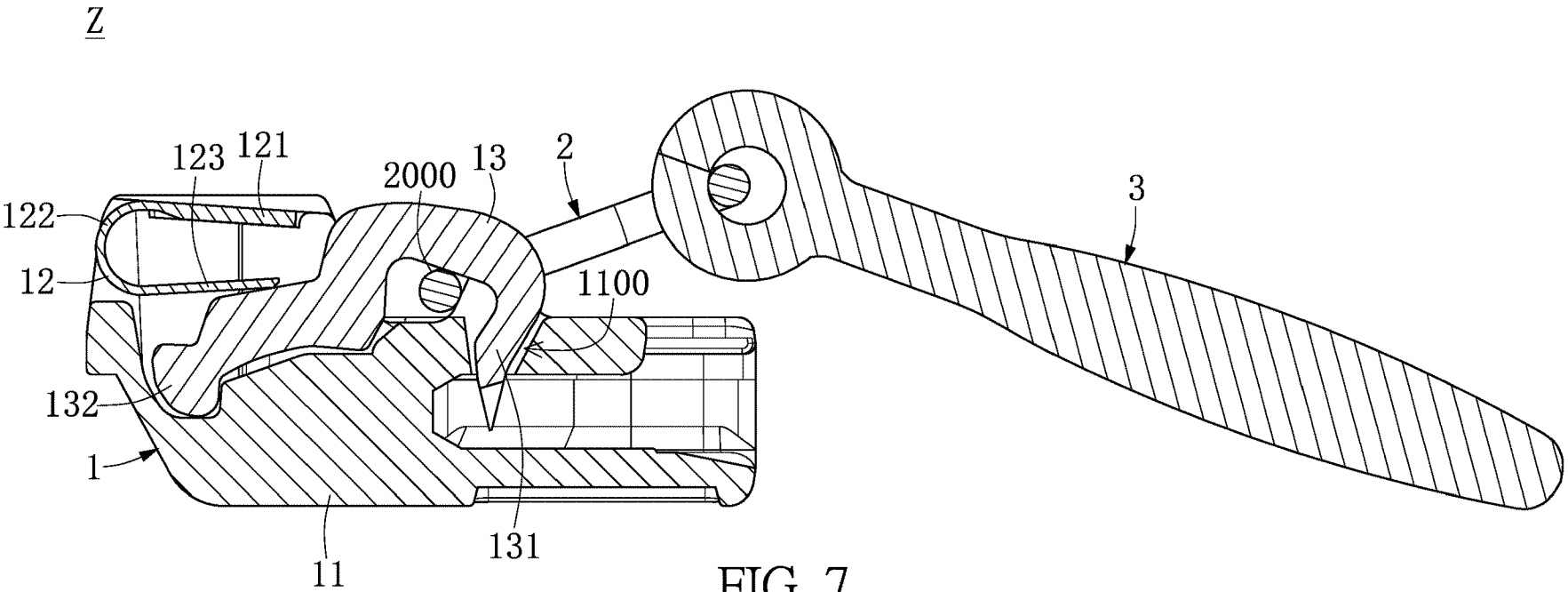
FIG. 7 is a cross-sectional view taken along line VII-VII of FIG. 6.

Referring to FIG. 5 to FIG. 7, a second embodiment of the present disclosure provides the zipper slider assembly structure Z. The zipper slider assembly structure Z includes the sliding assembly 1, the connecting ring 2, and the pull element 3. Based on the comparison between FIG. 5 and FIG. 1 and the comparison between FIG. 7 and FIG. 4, the difference between the second embodiment and the first embodiment is illustrated as follows.

Referring to FIG. 5 and FIG. 7, the elastic element 12 has a fixed part 121 fixed on the bottom part 113, an elastic part 122 extending from the fixed part 121, and an abutted part 123 extending from the elastic part 122 and abutted against the movable fixing element 13. In addition, the movable fixing element 13 is movably disposed on the bottom part 113 and the movable fixing element 13 can movably contact the abutted part 123 of the elastic element 12. Furthermore, a thickness of the elastic part 122 is smaller than a thickness of the fixed part 121 to increase an elastic coefficient or an elastic property of the elastic part 122.

For instance, referring to FIG. 5 and FIG. 7, the fixed part 121 has a front fixed segment, a back fixed segment connected with the elastic part 122, and a middle fixed segment connected between the front fixed segment and the back fixed segment. A width of the back fixed segment is smaller than a width of the front fixed segment, and a width of the middle fixed segment gradually shrinks from the front fixed segment toward the back fixed segment. In addition, the back fixed segment has a first fixed segment connected with the middle fixed segment and a second fixed segment connected between the first fixed segment and the elastic part 122. The thickness of the elastic part 122 is smaller than a thickness of the first fixed segment of the back fixed segment and a thickness of the second fixed segment of the back fixed segment. The thickness of the second fixed segment gradually shrinks from the first fixed segment toward the elastic part 122. However, the present disclosure is not limited thereto.

For instance, referring to FIG. 5 and FIG. 7, the bottom part 113 has a front retaining segment to fix the front fixed segment, a back retaining segment to fix the back fixed segment, and a middle retaining segment connected between the front retaining segment and the back retaining segment to fix the middle fixed segment. A width of the back retaining segment is smaller than a width of the front retaining segment, and a width of the middle retaining segment gradually shrinks from the front retaining segment toward the back retaining segment. Further, an outer surface of the bottom part 113 has at least one concave space concaved inward. An inner surface of the bottom part 113 has at least one bulge adjacent to the at least one concave space and corresponding to the at least one concave space. The at least one concave space and the at least one bulge are disposed on the back fixed segment of the fixed part 121. In addition, the retaining part 132 of the movable fixing element 13 is restricted in an accommodation recess of the bottom part 113. However, the present disclosure is not limited thereto.

For instance, referring to FIG. 5 and FIG. 7, a width of the abutted part 123 is larger than a width of the elastic part 122 to increase a contact area between the abutted part 123 and the movable fixing element 13. In addition, an end of the abutted part 123 has an oblique chamfer which can slidably contact the movable fixing element 13 to increase the contact area between the abutted part 123 and the movable fixing element 13. However, the present disclosure is not limited thereto.

Third Embodiment

Figure 8:
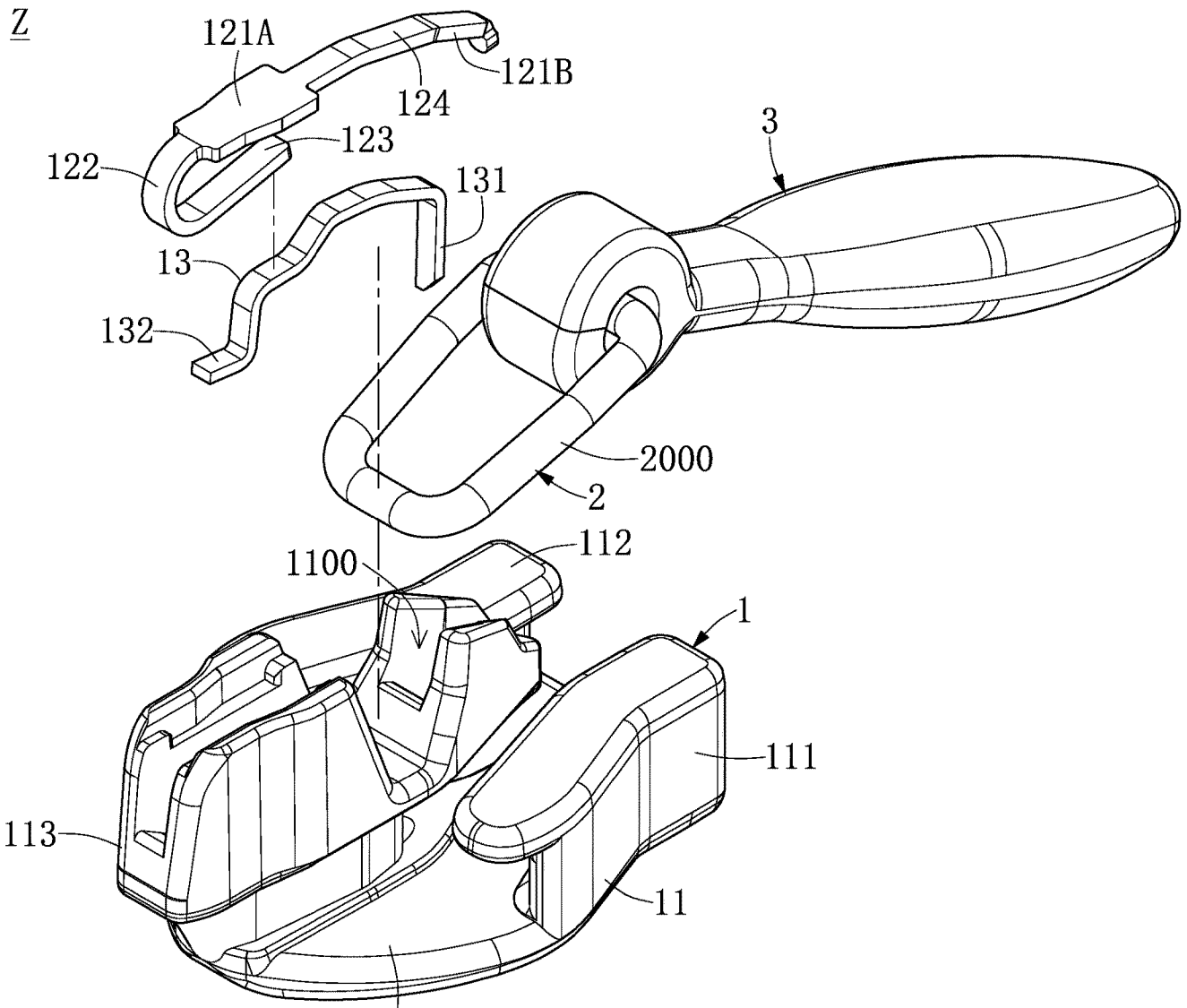
FIG. 8 is an exploded view of the zipper slider assembly structure according to a third embodiment of the present disclosure.
Figure 9:
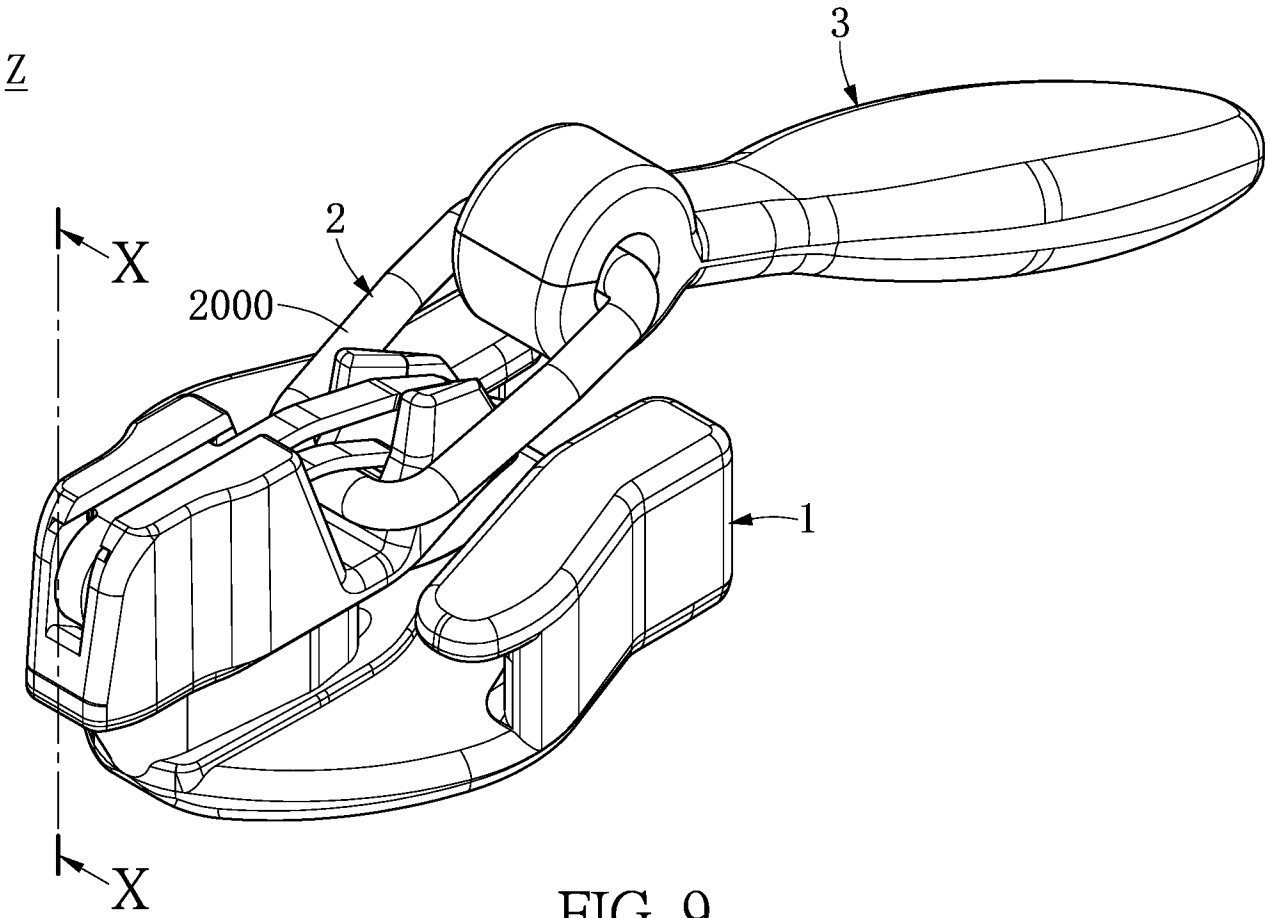
FIG. 9 is an assembled perspective view of the zipper slider assembly structure according to the third embodiment of the present disclosure.
Figure 10:
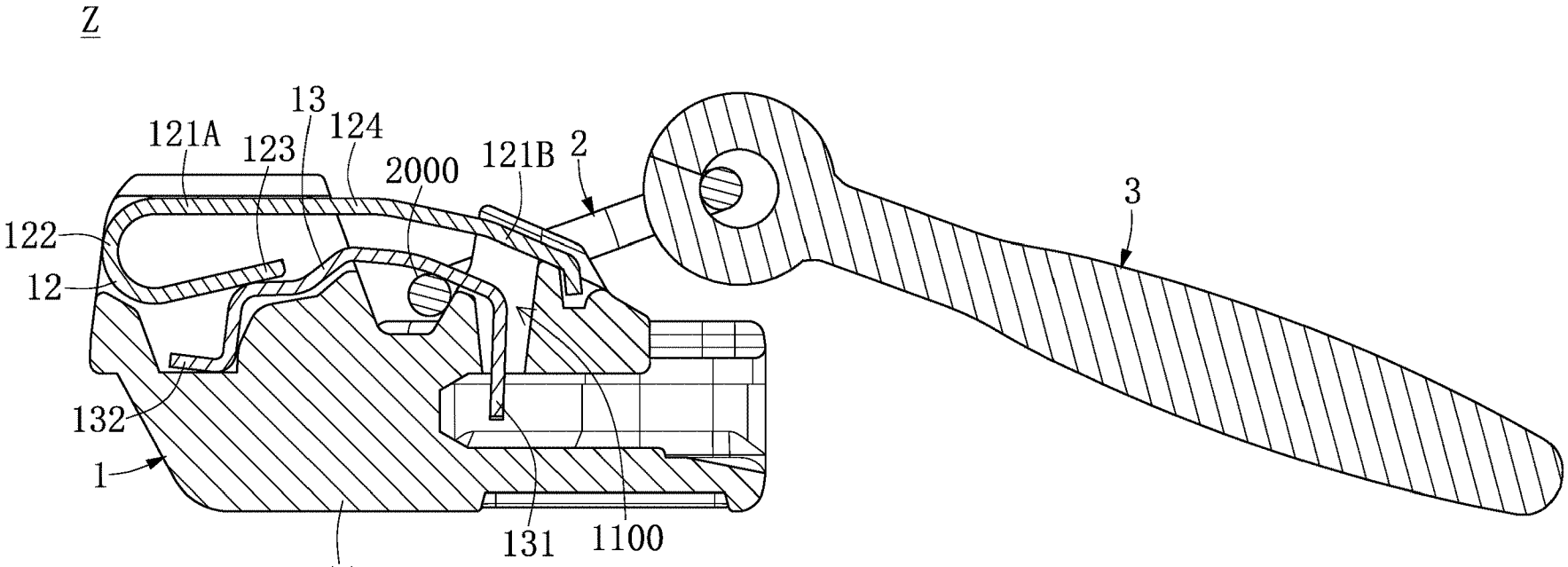
FIG. 10 is a cross-sectional view taken along line X-X of FIG. 9.

Referring to FIG. 8 to FIG. 10, a third embodiment of the present disclosure provides the zipper slider assembly structure Z. The zipper slider assembly structure Z includes the sliding assembly 1, the connecting ring 2, and the pull element 3. Based on the comparison between FIG. 8 and FIG. 1 and the comparison between FIG. 10 and FIG. 4, the difference between the third embodiment and the first embodiment is illustrated as follows.

Referring to FIG. 8 and FIG. 10, the elastic element 12 has a first fixed part 121A fixed on the bottom part 113, a second fixed part 121B fixed on the bottom part 113, an elastic part 122 extending from the first fixed part 121A, an abutted part 123 extending from the elastic part 122 and abutted against the movable fixing element 13, and an exposed part 124 connected between the first fixed part 121A and the second fixed part 121B and exposed from an outside of the bottom part 113. In addition, the movable fixing element 13 can be movably disposed on the bottom part 113 and the movable fixing element 13 can movably contact the abutted part 123 of the elastic element 12. Furthermore, a thickness of the elastic part 122 is smaller than a thickness of the first fixed part 121A to increase an elastic coefficient or an elastic property of the elastic part 122.

For instance, referring to FIG. 8 and FIG. 10, the fixed part has a front fixed segment, a back fixed segment connected with the elastic part 122, and a middle fixed segment connected between the front fixed segment and the back fixed segment. A width of the back fixed segment is smaller than a width of the front fixed segment and a width of the middle fixed segment gradually shrinks from the front fixed segment toward the back fixed segment. In addition, the back fixed segment has a first fixed segment connected with the middle fixed segment and a second fixed segment connected between the first fixed segment and the elastic part 122. The thickness of the elastic part 122 is smaller than a thickness of the first fixed segment and a thickness of the second fixed segment. A thickness of the second fixed part 121A gradually shrinks from the first fixed segment toward the elastic part 122. Furthermore, a thickness of the first fixed part 121A, a thickness of the second fixed part 121B, and a thickness of the exposed part 124 are substantially equal. The thickness of the elastic part 122 and a thickness of the abutted part 123 are substantially equal. A width of the abutted part 123 is larger than or substantially equal to a width of the elastic part 122. The movable fixing element 13 substantially has a uniform thickness. However, the present disclosure is not limited thereto.

For instance, referring to FIG. 8 and FIG. 10, the bottom part 113 has a front retaining segment to fix the front fixed segment, a back retaining segment to fix the back fixed segment, a middle retaining segment connected between the front retaining segment and the back retaining segment to fix the middle fixed segment, and an auxiliary retaining segment separated from the front retaining segment to fix the second fixed part 121B. A width of the back retaining segment is smaller than a width of the front retaining segment, and a width of the middle retaining segment gradually shrinks from the front retaining segment toward the back retaining segment. In addition, an outer surface of the bottom part 113 has at least one concave space concaved inward. An inner surface of the bottom part 113 has at least one bulge adjacent to the concave space and corresponding to the at least one concave space. The at least one concave space and the at least one bulge are both disposed on the back retaining segment of the bottom part 113. Furthermore, the bottom part 113 has a first accommodation recess and a second accommodation recess. Another end of the movable fixing element 13 has a retaining part 132 passing through the bulge and restricted in the first accommodation recess. The second fixing part 121B has a fixing object restricted in the second accommodation recess. However, the present disclosure is not limited thereto.

In conclusion, the zipper slider assembly structure Z and the connecting ring 2 thereof of the present disclosure have technical features of "connecting ring 2 movably cooperates with a pull element 3 and a movable fixing element 13 of the zipper slider assembly structure Z" and "connecting ring 2 is formed by encircling a wire rod into a loop with a predetermined diameter" to decrease a contact area between the connecting ring 2 and the sliding assembly 1 so as to effectively reduce a friction consumption thereof and decrease a contact area between the connecting ring 2 and the pull element 3 so as to effectively reduce a friction consumption thereof.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A zipper slider assembly structure, comprising:

a sliding assembly including a sliding element, an elastic element, and a movable fixing element, the sliding element having a through hole, the elastic element disposed on the sliding element and elastically abutted against the movable fixing element, the movable fixing element movably disposed on the sliding element, and an end of the movable fixing element having a limiting part passing through the through hole;

a connecting ring movably cooperating with the movable fixing element; and a pull element movably cooperating with the connecting ring;

wherein the connecting ring is formed by encircling a wire rod into a loop with a predetermined diameter, the connecting ring has a first end, a second end, and an interface-connecting structure connected between the first end and the second end, and a material of the interface-connecting structure and a material of the connecting ring are the same or different;

wherein the connecting ring has an outer arc surface around thereof, the outer arc surface of the connecting ring contacts the sliding assembly and the pull element by point-contact;

wherein the sliding element has a base part, a first side baffle, a second side baffle, and a bottom part, the first side baffle and the second side baffle respectively extend upward from two opposite edges of the base part, the first side baffle and the second side baffle correspond to each other and are connected with a front edge of the base part, the bottom part is disposed on the base part and is connected with a back edge of the base part; wherein the through hole extends through the bottom part and is located between the first side baffle and the second side baffle, and the movable fixing element is movably disposed on the bottom part;

wherein the elastic element has a fixed part fixed on the bottom part, an elastic part extending from the fixed part, and an abutted part extending from the elastic part and abutted against the movable fixing element, the movable fixing element movably contacts the elastic element, and a thickness of the elastic part is smaller than a thickness of the fixed part;

wherein another end of the movable fixing element has a retaining part, the retaining part of the movable fixing element is restricted in an accommodation recess of the bottom part; wherein a width of the abutted part is larger than a width of the elastic part, an end of the abutted part has an oblique chamfer which slidably contacts the movable fixing element to increase a contact area between the abutted part and the movable fixing element.

2. A zipper slider assembly structure, comprising:

a sliding assembly including a movable fixing element;

a connecting ring formed by encircling a wire rod into a loop with a predetermined diameter, and the connecting ring movably cooperating with the movable fixing element; and a pull element movably cooperating with the connecting ring;

wherein the connecting ring has an outer arc surface around thereof;

wherein the sliding assembly includes a sliding element and an elastic element, and the sliding element has a base part and a bottom part; wherein the elastic element has a first fixed part fixed on the bottom part, a second fixed part fixed on the bottom part, an elastic part extending from the first fixed part, an abutted part extending from the elastic part and abutted against an abutted part of the movable fixing element, and an exposed part connected between the first fixed part and the second fixed part and exposed from an outside of the bottom part; wherein the movable fixing element movably contacts the abutted part of the elastic element, and the movable fixing element is movably disposed on the bottom part.

3. A zipper slider assembly structure, comprising:

a sliding assembly including a sliding element, an elastic element, and a movable fixing element, the sliding element having a through hole, the elastic element disposed on the sliding element and elastically abutted against the movable fixing element, the movable fixing element movably disposed on the sliding element, and an end of the movable fixing element having a limiting part passing through the through hole;

a connecting ring movably cooperating with the movable fixing element; and a pull element movably cooperating with the connecting ring;

wherein the connecting ring is formed by encircling a wire rod into a loop with a predetermined diameter, the connecting ring has a first end, a second end, and an interface-connecting structure connected between the first end and the second end, and a material of the interface-connecting structure and a material of the connecting ring are the same or different;

wherein the connecting ring has an outer arc surface around thereof, the outer arc surface of the connecting ring contacts the sliding assembly and the pull element by point-contact;

wherein the sliding element has a base part, a first side baffle, a second side baffle, and a bottom part, the first side baffle and the second side baffle respectively extend upward from two opposite edges of the base part, the first side baffle and the second side baffle correspond to each other and are connected with a front edge of the base part, the bottom part is disposed on the base part and is connected with a back edge of the base part; wherein the through hole extends through the bottom part and is located between the first side baffle and the second side baffle, and the movable fixing element is movably disposed on the bottom part;

wherein the elastic element has a first fixed part fixed on the bottom part, a second fixed part fixed on the bottom part, an elastic part extending from the first fixed part, an abutted part extending from the elastic part and abutted against the movable fixing element, and an exposed part connected between the first fixed part and the second fixed part and exposed from an outside of the bottom part; wherein the movable fixing element movably contacts the abutted part of the elastic element, and the movable fixing element is movably disposed on the bottom part.

4. The zipper slider assembly structure according to claim 3, wherein a thickness of the elastic part is smaller than a thickness of the first fixed part to increase an elastic coefficient of the elastic part; wherein the thickness of the first fixed part, a thickness of the second fixed part, and a thickness of the exposed part are the same, the thickness of the elastic part and a thickness of the abutted part are the same, a width of the abutted part is larger than or equal to a width of the elastic part, and the movable fixing element has a uniform thickness.

* * * * *